US012383817B2

(12) United States Patent
Chen

(10) Patent No.: US 12,383,817 B2
(45) Date of Patent: Aug. 12, 2025

(54) SLIDING PUZZLE TOY

(71) Applicant: Weihong Chen, Shantou (CN)

(72) Inventor: Weihong Chen, Shantou (CN)

( * ) Notice: Subject to any disclaimer, the term of this patent is extended or adjusted under 35 U.S.C. 154(b) by 0 days.

(21) Appl. No.: 18/529,959

(22) Filed: Dec. 5, 2023

(65) Prior Publication Data

US 2024/0226711 A1 Jul. 11, 2024

(30) Foreign Application Priority Data

Jan. 9, 2023 (CN) ..... 202320056772.1
Oct. 10, 2023 (CN) ..... 202322716462.0

(51) Int. Cl.
*A63F 9/08* (2006.01)

(52) U.S. Cl.
CPC ..... *A63F 9/0857* (2013.01)

(58) Field of Classification Search
CPC ..... A63F 9/083; A63F 9/0857; A63F 9/0865; A63F 2009/0892
See application file for complete search history.

(56) References Cited

U.S. PATENT DOCUMENTS 4,526,372 A * 7/1985 Kikis ..... A63F 3/00634 273/153 S
4,872,682 A * 10/1989 Kuchimanchi ..... A63F 9/083 273/153 S
7,243,918 B2 * 7/2007 Vernon ..... A63F 9/0803 273/153 S
7,547,019 B2 * 6/2009 Chen ..... A63F 9/0865 273/156
8,387,984 B2 * 3/2013 Artsiely ..... A63F 9/0823 273/153 S
10,245,504 B2 * 4/2019 Yang ..... A63F 9/0842
2020/0054937 A1 * 2/2020 Cao ..... A63F 7/047

FOREIGN PATENT DOCUMENTS

DE 3039513 A * 5/1982 ..... A63F 9/0803
DE 9418860 U1 * 4/1995
DE 202008002004 U1 * 5/2008 ..... A63F 9/083
FR 2549381 A1 * 1/1985
FR 2790972 A1 * 9/2000 ..... A63F 9/083
GB 2176410 A * 12/1986 ..... A63F 9/083
WO WO-2018230763 A1 * 12/2018 ..... A63F 9/08

* cited by examiner

*Primary Examiner* — Steven B Wong

(57) ABSTRACT

A sliding puzzle toy is provided, including a main body and sliders slidably connected to the main body. The main body includes two bottom walls and a side wall, wherein at least one of the two bottom walls is provided with a recessed slot and a separable block, one side of the recessed slot is connected to the side wall, an arc transition is provided at a connection between the recessed slot and the side wall, and the separable block is movably or detachably connected to the recessed slot. The outer surface of the side wall is provided with sliding grooves that intersects with each other along circumferential and longitudinal directions, the sliding grooves are movably connected to the sliders, and one of the longitudinal sliding grooves passes through a connection between the recessed slot and the side wall and extends towards a bottom wall of the recessed slot.

3 Claims, 19 Drawing Sheets

SLIDING PUZZLE TOY

CROSS-REFERENCE

This application claims to the benefit of priority from Chinese Application No. 202320056772.1 with a filing date of Jan. 9, 2023, and further claims to the benefit of priority from Chinese Application No. 2023227164620 with a filing date of Oct. 10, 2023. The content of the aforementioned applications, including any intervening amendments thereto, are incorporated herein by reference.

TECHNICAL FIELD

The present disclosure relates to the technical field of toys, particularly to a sliding puzzle toy.

BACKGROUND

At present, sliding puzzle toys include two types: flat puzzle toys and sliding puzzle toys. In related arts, sliding puzzle toys generally include a main body and a plurality of sliders. The plurality of sliders slide on the surface of the main body to create corresponding patterns. Because the slider gap on the surface of the main body is only one grid, in order to achieve the goal of creating a complete pattern, the slider must be cleverly moved. Therefore, this type of toy is both interesting and can exercise intelligence of user, especially for inspiring children's intelligence. However, due to the presence of a slider gap, not only dust and other impurities can easily enter the main body, but also affect the overall aesthetics of the sliding puzzle toy. In related art, separable puzzle unit blocks are provided on the main body to open or close the slider gap, such as a puzzle toy disclosed in patent document CN203469438U. However, in the structure of the puzzle toy disclosed in the above patent document, the separable puzzle unit blocks are connected to the cylinder (i.e. the main body) through an open structure, which is complex and not conducive to simplifying assembly materials, reducing manufacturing costs, and also not conducive to improving the assembly efficiency of the puzzle toy.

SUMMARY

The present disclosure aims to solve at least one of the technical problems existing in the existing technology. Therefore, this present disclosure provides a sliding puzzle toy, aiming to solve the problem of complex connection structure between separable puzzle unit blocks and the main body in existing puzzle toys, which is not conducive to reducing costs and improving work efficiency.

To achieve the above objective, a sliding puzzle toy is provided by the present disclosure, including a main body and a plurality of sliders slidably connected to the main body, wherein the main body includes two end walls and a side wall connected between the two end walls, at least one of the two end walls is provided with a recessed slot and a separable block, one side of the recessed slot is connected to the side wall, an arc transition is provided at a connection between the recessed slot and the side wall, and the separable block is movably or detachably connected to the recessed slot; an outer surface of the side wall is provided with a plurality of sliding grooves that intersects with each other along circumferential and longitudinal directions, the sliding grooves are movably connected to the sliders, and one of the longitudinal sliding grooves passes through a connection between the recessed slot and the side wall and extends towards a bottom wall of the recessed slot.

As the preferred solution, the separable block matches with the recessed slot, one side of the separable block is detachably connected to an open side of the recessed slot, and an other side of the separable block is pivoted to a side wall of the recessed slot.

As the preferred solution, two side walls opposite each other in the recessed slot are respectively provided with a connection slot, two side walls opposite each other of the separable block are respectively provided with snap bulges, and the snap bulges are arranged corresponding to the connection slot and is detachably connected in the connection slot.

As the preferred solution, a bottom wall of the recessed slot is provided with a positioning slot adjacent to the connection slot, the two side walls opposite each other of the separable block protrude towards a position of the positioning slot to form snap blocks, and the snap blocks match with the positioning slot and detachably connected to the positioning slot.

As the preferred solution, the separable block is connected to the end wall through a connection strip, the connection strip is accommodated and connected between the separable block and the end wall, and the two ends of the connection strip are respectively pivoted to the separable block and the end wall.

As the preferred solution, the separable block is slidably connected within the recessed slot, and a length of the separable block is equal to or less than a length of the recessed slot;

when the length of the separable block is equal to the length of the recessed slot, an other side of the recessed slot is connected to an outside;

when the length of the separable block is less than the length of the recessed slot, some part of the recessed slot is recessed to form a receiving cavity, a moving block is movably connected within the receiving cavity, and the moving block has a first state adjacent to the separable block and a second state overlapping with the separable block.

As the preferred solution, the side wall of the recessed slot is provided with a guide slot along a direction of movement of the separable block, the separable block is provided with a first sliding plate on the side wall opposite to the guide slot, and the first sliding plate and the guide slot are in a concave-convex sliding fit.

As the preferred solution, the side wall of the recessed slot is provided with a limit slot along a direction of movement of the separable block, the separable block is provided with a second sliding plate on the side wall opposite to the limit slot, and the second sliding plate and the limit slot are in a concave-convex sliding fit.

As the preferred solution, the recessed slots include at least two sub slots that intersect with each other, an intersection position of any two sub slots is recessed to form the receiving cavity, and each sub slot is provided with at least one separable block in a sliding manner.

As the preferred solution, any separable block is provided with the guide slot on the side wall adjacent to the moving block.

As the preferred solution, a bottom wall of the receiving cavity is further provided with a moving cavity, and the moving block is provided with a connection post on the side wall corresponding to the moving cavity, and the connection post is movably connected within the moving cavity.

As the preferred solution, the bottom wall of the receiving cavity is connected to the moving block and/or a bottom wall of the moving cavity is connected to the connection post through at least one elastic member.

As the preferred solution, a side wall of the moving cavity are circumferentially provided with a plurality of guiding ribs at intervals, and each end of the guiding ribs is provided with a first inclined surface, the first inclined surface is arranged in an inclined Z-shaped shape, and the connection post is movably connected to the moving cavity through a pushing block and a limit block;

the pushing block is fixed to the connection post and is slidably connected between the plurality of guiding ribs, and an end of the pushing block in the moving cavity is provided with serrated claws in a circumferential direction; and the limit block is connected to a bottom wall of the moving cavity through an elastic member, and an outer wall of the limit block is provided with a plurality of positioning ribs; each positioning rib is slidably connected between any two guiding ribs, each positioning rib is provided with a second inclined surface at an end opposite to the serrated claws, the second inclined surface contacts with the serrated claws, and an inclination direction and an inclination angle of each second inclined surface are the same as those of the first inclined surface.

As the preferred solution, the bottom wall of the moving cavity is provided with a mounting hole, and the connection post is movably connected to the moving cavity through a restriction block and a restriction rod;

the restriction block is fixed to the connection post and is slidably connected in the moving cavity, one side of the restriction block is provided with a channel, the channel is provided with a recessed point recessed downwards; and one end of the restriction rod is fixed in the mounting hole, and an other end of the restriction rod is movably connected in the channel and connected or separated from the recessed point.

As the preferred solution, the side wall is a closed curved surface, or the side wall includes at least three closed connected planes, and each two adjacent planes are connected by an arc-shaped transition surface.

As the preferred solution, each slider includes a plate and a base pillar arranged along a vertical direction, the plate is exposed to the side wall, the base pillar is movably connected in the sliding groove, a positioning piece is slidably sleeved on the base pillar, the positioning piece is movably connected to the sliding groove and contacts with an inner wall of the sliding groove, and an elastic member is connected between the positioning piece and an end of the base pillar.

Therefore, based on the technical means of the present disclosure, a brief explanation of the advantages that the present disclosure can achieve is as follows: In the sliding puzzle toy provided by the present disclosure, by setting the recessed slot on the bottom wall, the recessed slot and the side wall are connected to serve as a slider gap; and at the same time, by setting the separable block on the bottom wall that is movably or detachably connected with the recessed slot, such that the separable block can be flipped or moved within the recessed slot, or can be separated and disassembled from the recessed slot. When in use, through flipping, moving or disassembling the separable block to open or close the slider gap. Compared with existing structures, by setting the recessed slots and separable blocks which movably or detachably connected with each other on the bottom wall, it can effectively simplify the connection structure between the separable block and the main body, which is beneficial for reducing costs and improving assembly efficiency. Moreover, by setting the recessed slots and separable blocks which movably or detachably connected with each other on the bottom wall, it can make the opening or closing of the separable block simpler and faster, making it easier for game operations. It can also separate the separable block from the slider, compared with the existing structure, the pattern formed by the splicing of several sliders on the side wall is not limited by the separable block (pattern), and the relative position of the splicing pattern on the side wall can be changed at any time, making the sliding puzzle toy more playable and lasting appeal.

Figure 1:
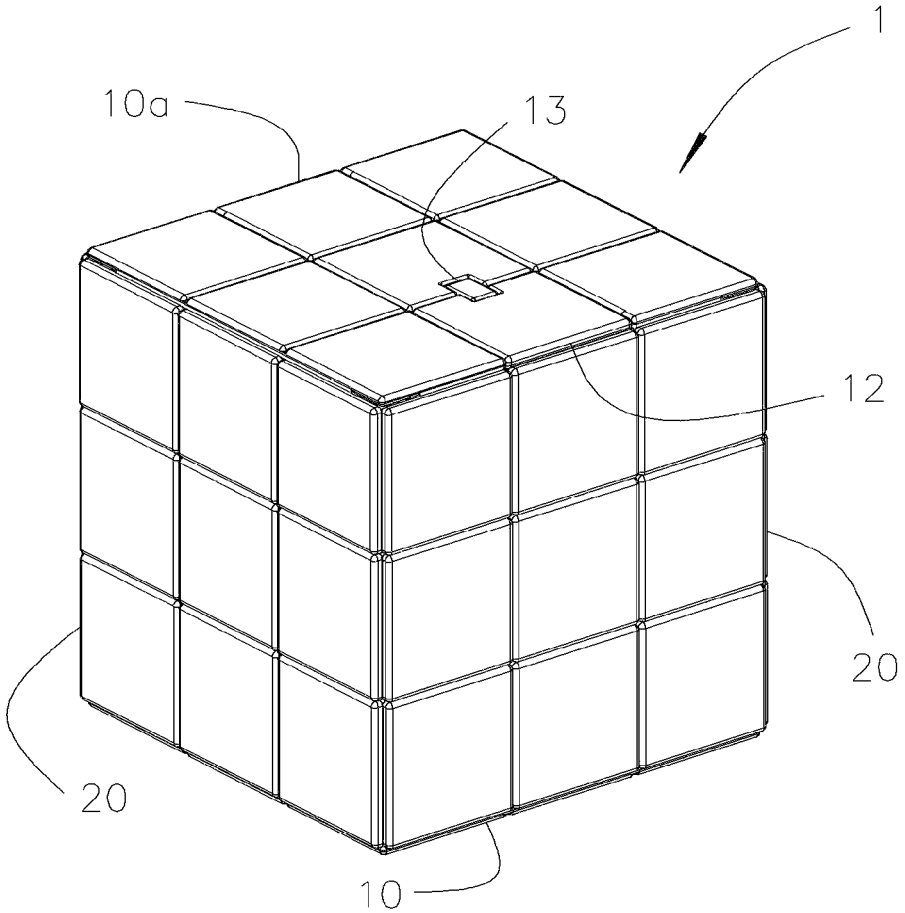
FIG. 1 is a schematic diagram of a sliding puzzle toy in the first embodiment of this present disclosure.
Figure 2:
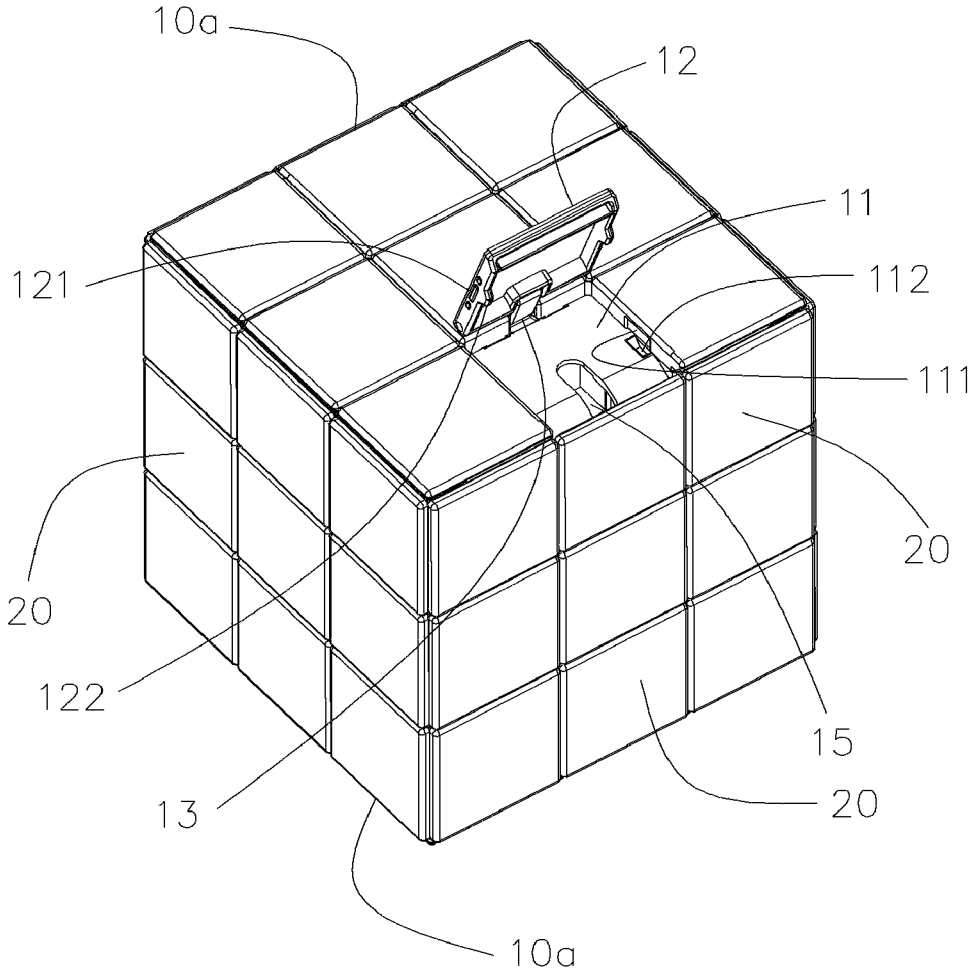
FIG. 2 is a schematic diagram of the separable block in opened state of the sliding puzzle toy in FIG. 1.
Figure 3:
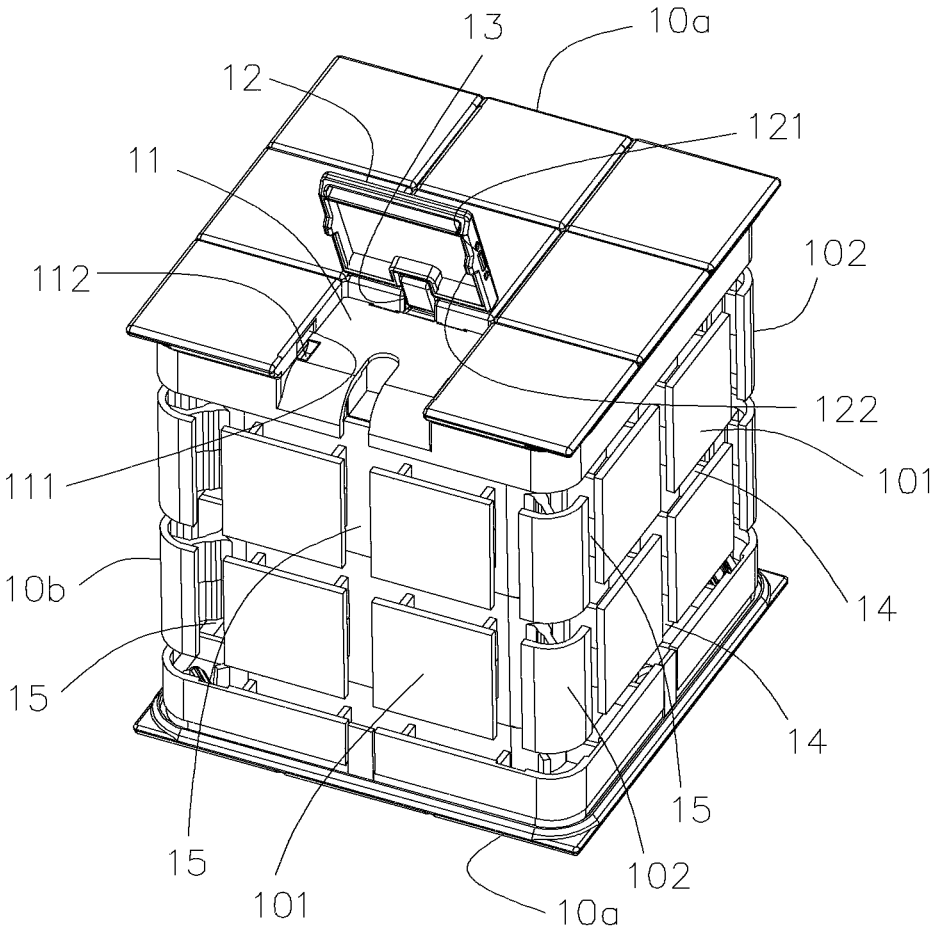
FIG. 3 is a schematic diagram of the main body in FIG. 2.
Figure 4:
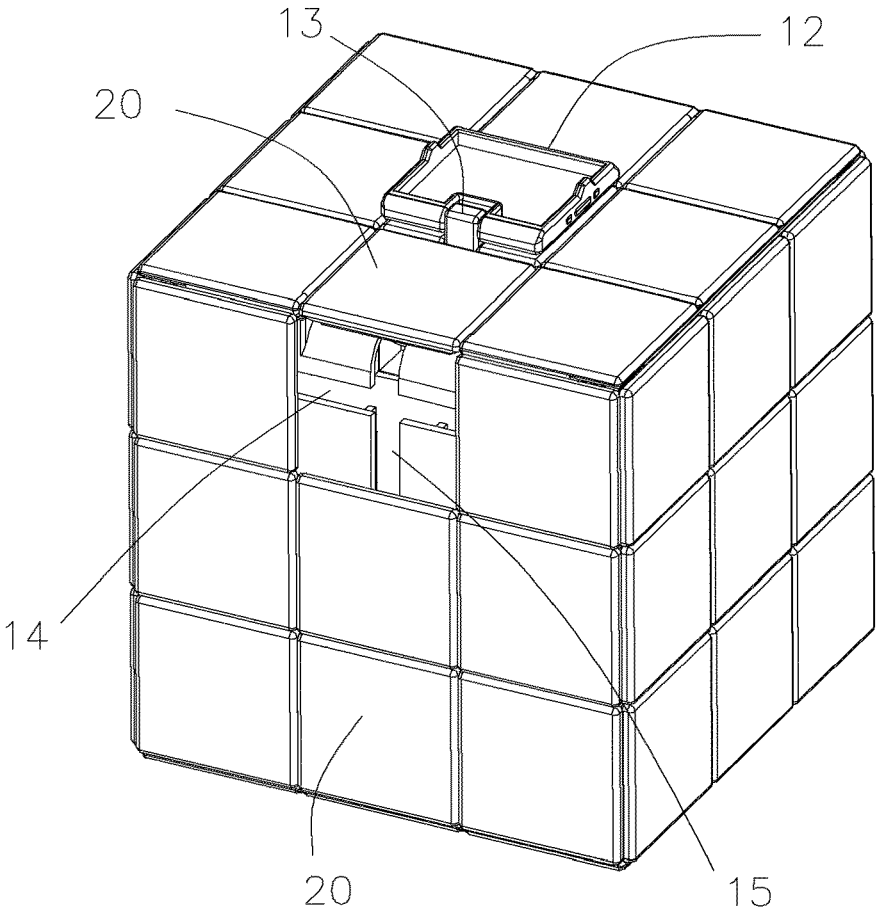
FIG. 4 is a schematic diagram when the sliding puzzle toy in FIG. 2 is used.
Figure 5:
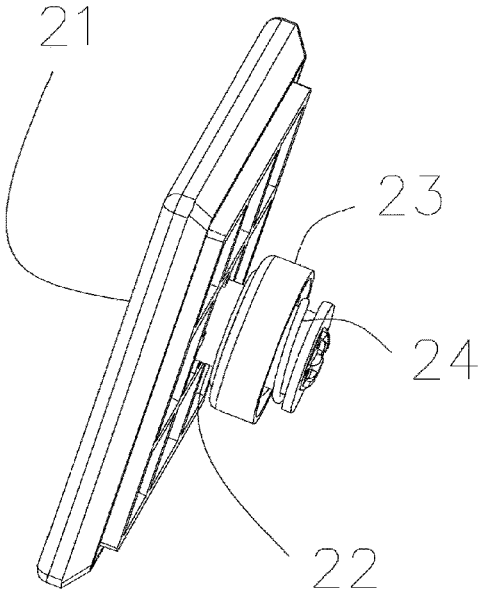
FIG. 5 is a schematic diagram of the slider in FIG. 1.
Figure 6:
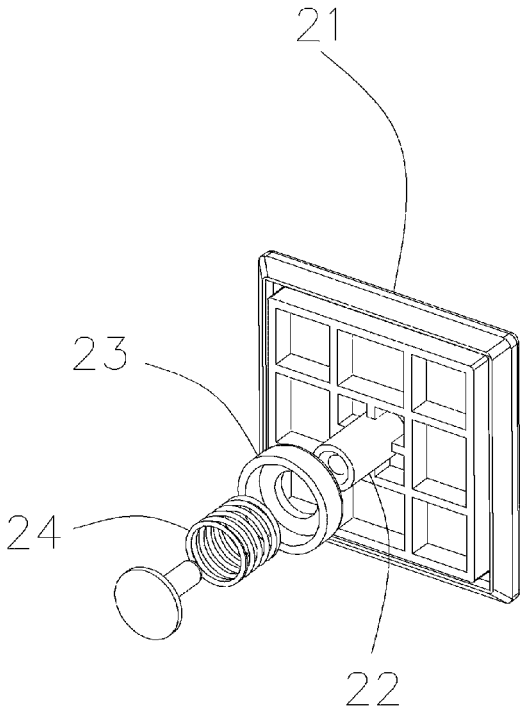
FIG. 6 is an exploded view of the slider in FIG. 5.
Figure 7:
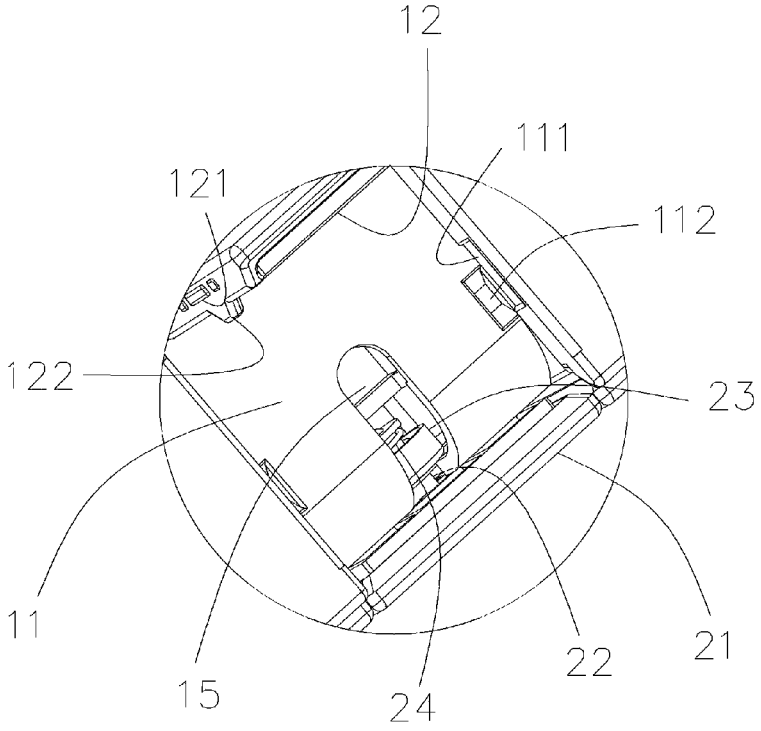
FIG. 7 is a schematic diagram of the slider in FIG. 2 connected to the main body.

In the picture: 1—sliding puzzle toy; 10—main body; 10*a*—end wall; 11—recessed slot; 111—connection slot; 112—positioning slot; 110—sub slot; 113—guide slot; 114—limit slot; 115—receiving cavity; 1151—retaining ring; 1152—moving cavity; 1153—guiding rib; 1154—first inclined surface; 1155—mounting hole; 12—separable block; 121—snap bulge; 122—snap block; 123—first sliding plate; 124—second sliding plate; 13—connection strip;

10*b*—side wall; 14—circumferential sliding groove; 15—longitudinal sliding groove; 101—plane; 102—arc-shaped transition surface; 16—moving block; 161—connection post; 17*a*—pushing block; 171—serrated claw; 17*b*—limit block; 172—positioning rib; 173—second inclined surface; 18*a*—restriction block; 181—channel; 1811—recessed point; 182—raised rib; 18*b*—restriction rod; 103—first spring; 104—second spring; 20—slider; 21—plate; 22—base pillar; 23—positioning piece; 24—elastic member.

DETAILED DESCRIPTION OF THE EMBODIMENTS

The following will provide a clear and complete description of the technical solution in the embodiments of this present disclosure in conjunction with the attached drawings. Obviously, the described embodiments are only a part of the embodiments of this present disclosure, not all of them. Based on the embodiments in this present disclosure, all other embodiments obtained by ordinary skilled person in the art without creative labor fall within the scope of this present disclosure. It can be understood that the attached drawings are only for reference and illustration purposes and are not intended to limit the present disclosure. The connections shown in the attached drawings are only for the purpose of clear description and do not limit the connection method.

It should be understood that the terms "up", "down", "front", "back", "left", "right", "top", "bottom", "inside", "outside", etc. are based on the attached drawings to describe the direction or position relationship shown in the present disclosure. They are only for the convenience of describing the present disclosure and simplifying the description, rather than indicating that the device or component referred to must have a special direction or position relationship, thus, it cannot be understood as a limitation on the present present disclosure. Further, it should be noted that when a component is considered to be "connected" to another component, it may be directly or indirectly connected to another component. Unless otherwise defined, all technical and scientific terms used in this article have the same meanings as those commonly understood by the skilled person in the art of this present disclosure. The terms used in the specification of this present disclosure are only for the purpose of describing specific embodiments and are not intended to limit this present disclosure.

Please refer to FIG. 1 to FIG. 7, the first embodiment provides a sliding puzzle toy 1, which includes a main body 10 and a plurality of sliders 20 that can be slidably connected to the main body 10. In this embodiment, the main body 10 is roughly arranged in a square shape, including two end walls 10*a* and a side wall 10*b* connected between the two end walls 10*a*. It can be understood that since the main body 10 is roughly arranged in a square shape, the two end walls 10*a* are correspondingly arranged as squares, and the side walls 10*b* include four closed connected planes 101, wherein each two adjacent planes 101 are connected with an arc-shaped transition surface 102 to enable the sliders 20 to move more smoothly on the side walls 10*b*. It should be noted that the side length of end wall 10*a* is equal to the sum of the side length of side wall 10*b* and the thickness of two sliders 20. so as to make the outer surface of the sliding puzzle toy 1 smooth and tidy when the slider 20 is connected to the main body 10, making it easy to play.

Figure 8:
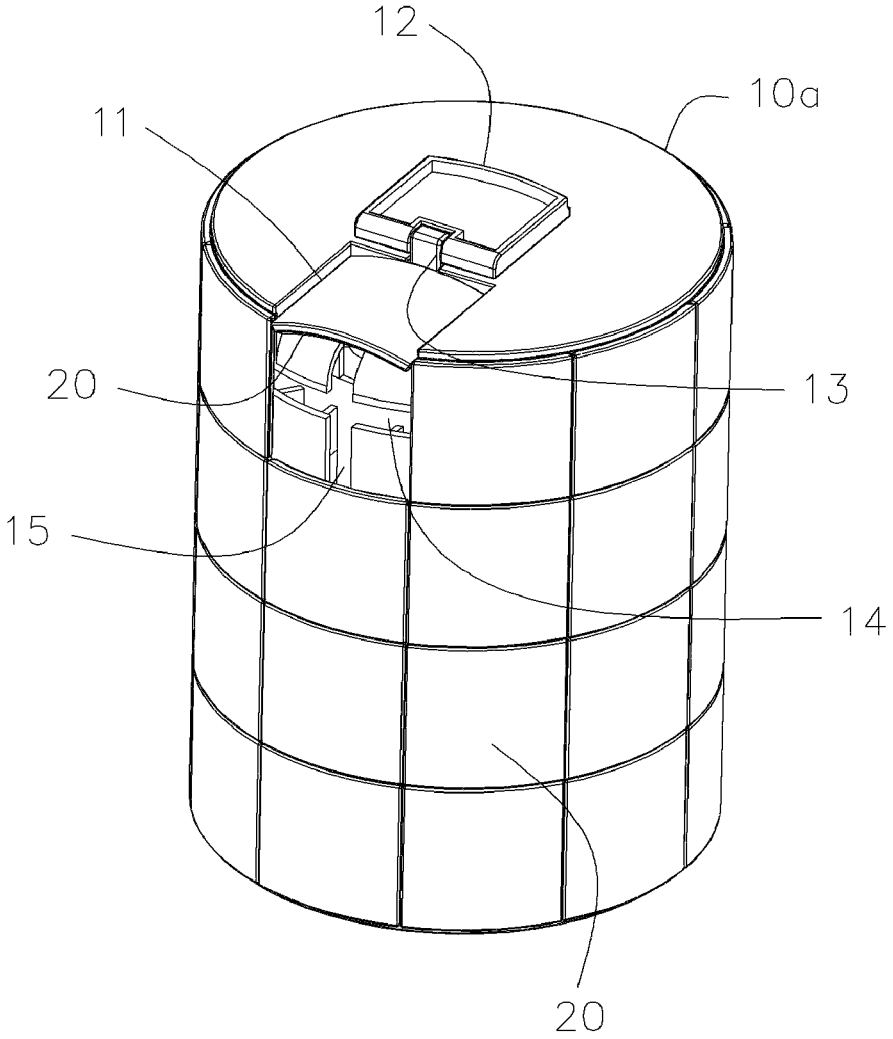
FIG. 8 is a schematic diagram when a sliding puzzle toy in the second embodiment of this present disclosure is used.
Figure 9:
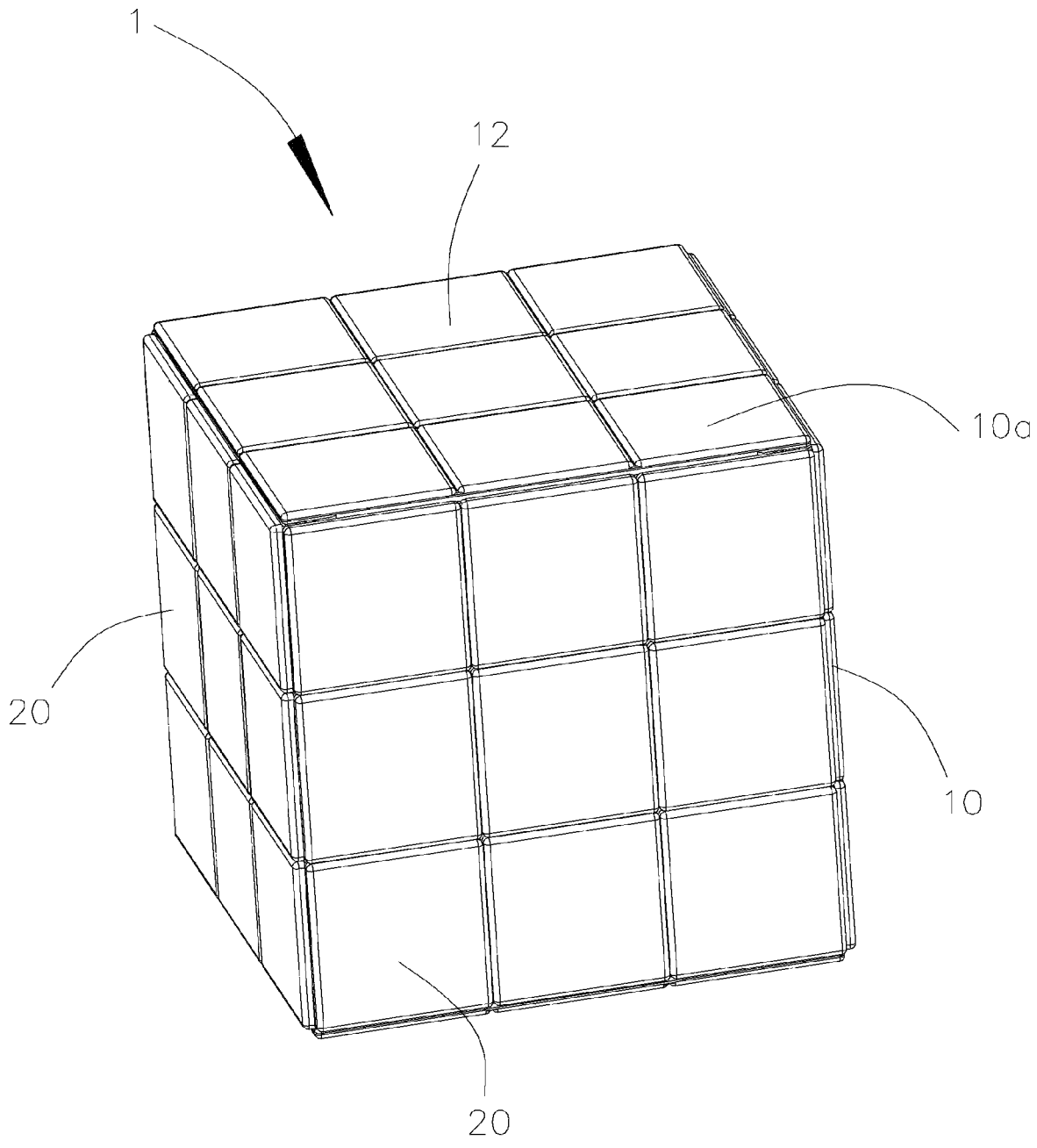
FIG. 9 is a schematic diagram of a sliding puzzle toy in the third embodiment of this present disclosure.
Figure 10:
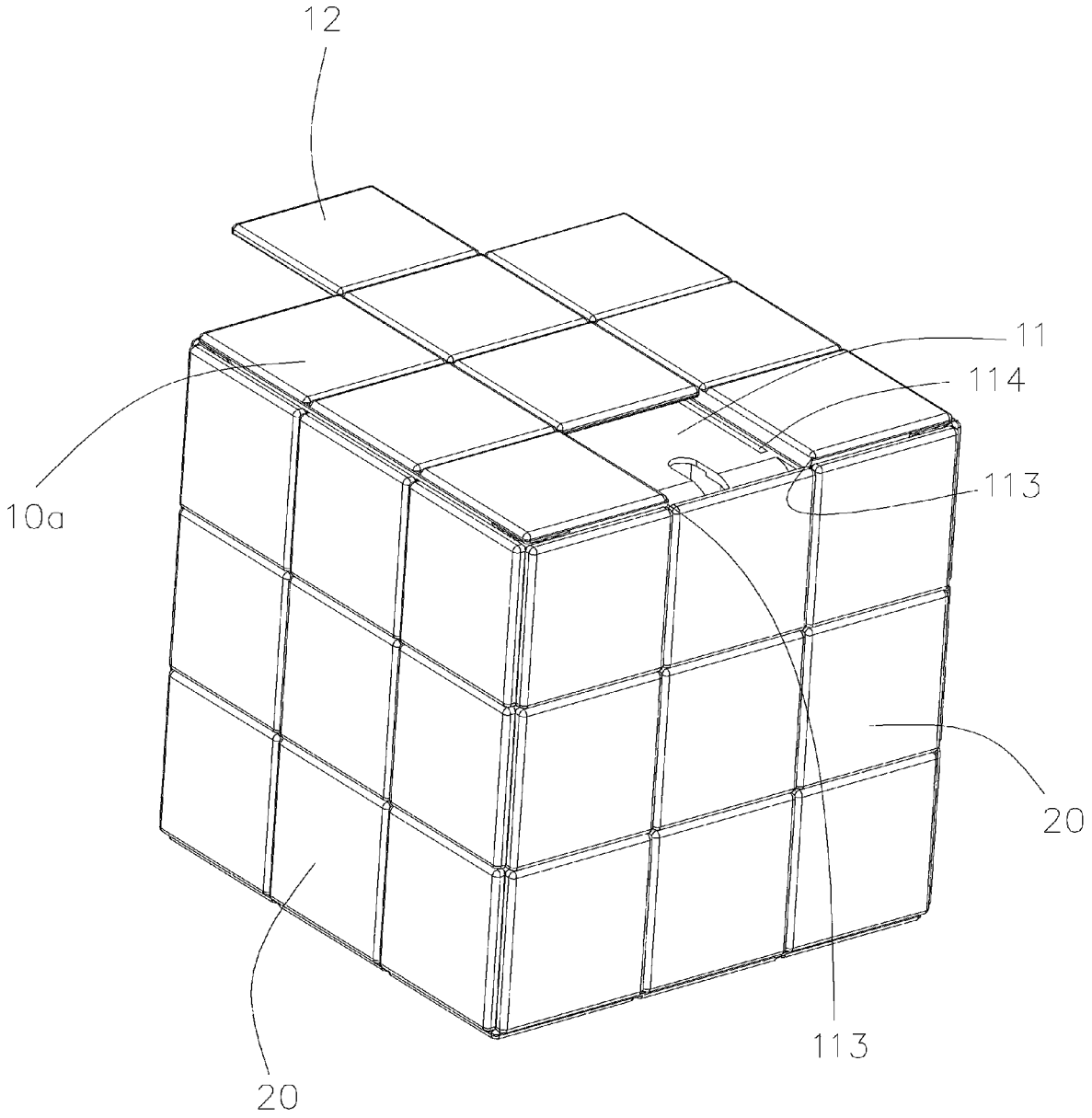
FIG. 10 is a schematic diagram of the separable block in opened state of the sliding puzzle toy in FIG. 9.
Figure 11:
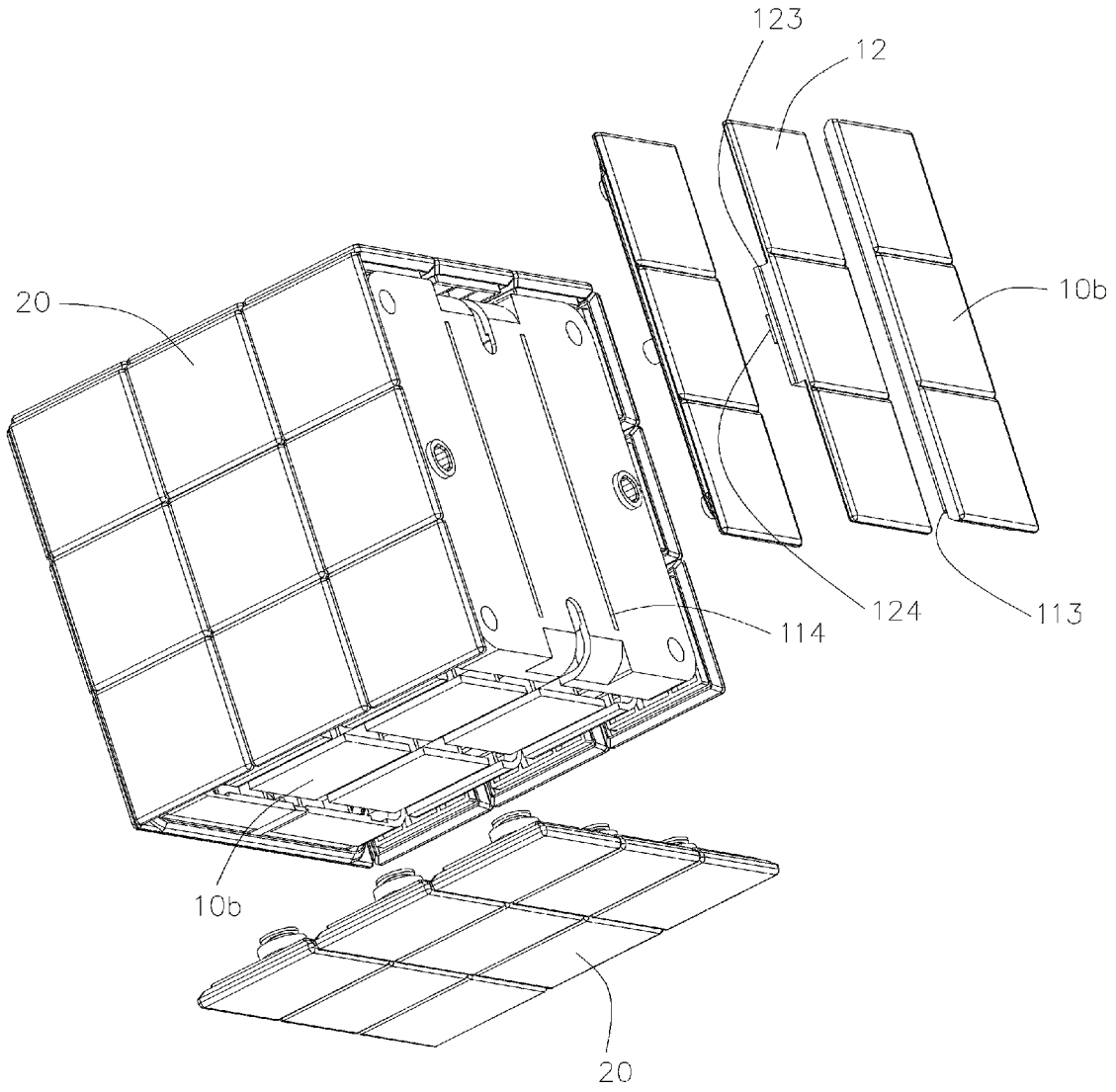
FIG. 11 is a partial exploded view of the sliding puzzle toy in FIG. 9.
Figure 12:
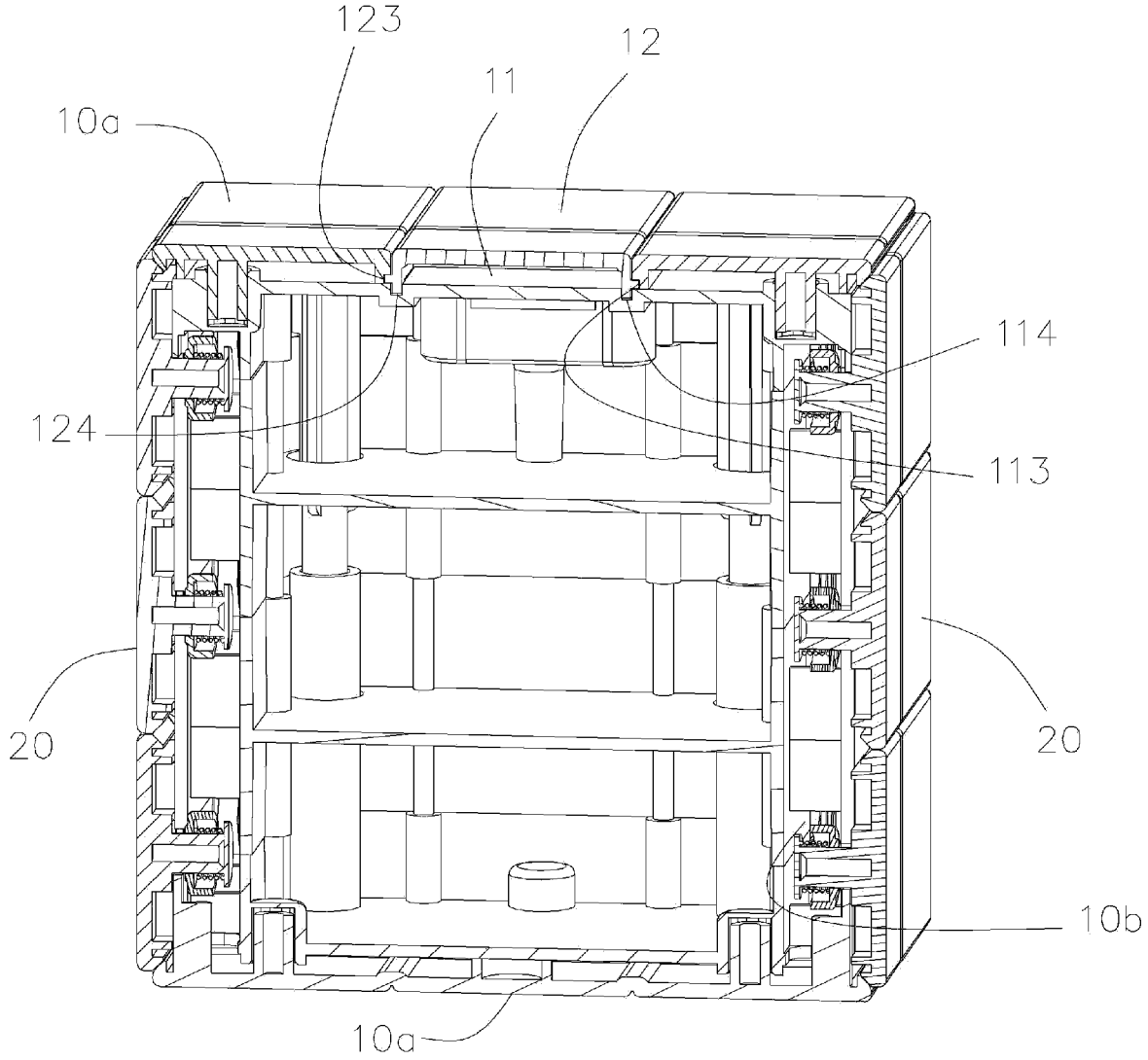
FIG. 12 is a cross-sectional schematic diagram of the sliding puzzle toy in FIG. 9.

In other embodiments of present disclosure, the main body 10 can also be arranged in other cylindrical structures, such as a cylinder (a sliding puzzle toy provided by the second embodiment as shown in FIG. 8), a triangular prism, or other multi prism structures. When the main body 10 is arranged in a cylinder, the end wall 10*a* is circular, and the side wall 10*b* is a closed curved surface; When the main body 10 is arranged in a triangular prism or other multi prism structure, the end wall 10*a* is a triangle or other polygon, and the side wall 10*b* includes three or a corresponding number of planes 101. Similarly, there is an arc-shaped transition surface 102 connected between every two adjacent planes 101. When the main body 10 is arranged in other columnar structures, the length or diameter of the end wall 10*a* and the side wall 10*b* should be adjusted adaptively based on the principle of making the outer surface of the sliding puzzle toy 1 smooth and tidy.

In the first embodiment, one of the bottom walls 10*a* is provided with a recessed slot 11 and a separable block 12. One side of the recessed slot 11 is connected to the side wall 10*b* to enable the recessed slot 11 to serve as a slider gap, and the connection between the recessed slot 11 and the side wall 10*b* has an arc-shaped transition to enable sliders 20 to move more smoothly between the recessed slot 11 and the side wall 10*b*. In other embodiments of present disclosure, it is not limited to setting recessed slots 11 and separable blocks 12 on only one end wall 10*a*, but can also set recessed slots 11 and separable blocks 12 on both bottom walls 10*a* simultaneously. The number of recessed slots 11 and separable blocks 12 on each end wall 10*a* can also be two, three, or more.

In the first embodiment, two connection slots 111 and two positioning slots 112 are also recessed inside the recessed slot 11. The two connection slots 111 are located on opposite sides of the walls inside the recessed slot 11, which are connected to the part of the separable block 12. The two positioning slots 112 are located on the bottom wall of recessed slot 11 and are adjacent to one connection slot 111, respectively, which are detachably connected to another part of the separable block 12. In other embodiments of present disclosure, the recessed slot 11 may not be equipped with a connection slot 111 and/or a positioning slot 112.

In the first embodiment, the separable block 12 is matched with the recessed slot 11, and one side of the separable block 12 is detachably connected to the open side of the recessed slot 11. The other side of the separable block 12 is pivoted to the side wall of the recessed slot 11 through the connection strip 13. Wherein the connection strip 13 is accommodated and connected between the separable block 12 and the end wall 10*a*, and the two ends of the connection strip 13 are respectively pivoted with the separable block 12 and the end wall 10*a*. The setting of the connection strip 13 allows the separable block 12 to have a high degree of rotational freedom relative to the end wall 10*a*. It can be understood that the separable block 12 and the recessed slot 11, which are pivoted and matched on the end wall 10*a*, can open or close the slider gap during the relative rotation of the separable block 12, allowing the slider 20 to move on the main body 10 to ensure the game can proceed, and can close the slider gap when idle to prevent dust and maintain the overall aesthetics of the sliding puzzle toy 1. In other embodiments of present disclosure, the separable block 12 can also be directly pivoted with the side wall of the recessed slot 11. Obviously, in other embodiments, the separable block 12 matches with the recessed slot 11 can also be directly and detachably connected to the recessed slot 11. When in use, the slider gap can be opened or closed by placing the separable block 12 in the recessed slot 11 or disassembling and separating the separable block 12 from the recessed slot 11.

In the first embodiment, the two side walls opposite each other of the separable block 12 are respectively provided with one snap bulge 121 and one snap block 122, wherein the snap bulge is arranged corresponding to the connection slot 111 and is detachably connected to the connection slot 111, which is used to enable the separable block 12 to be stably connected to the recessed slot 11 when the sliding puzzle toy 1 is idle, preventing the separable block 12 from detaching from the recessed slot 11 under gravity. The snap block 122 is located on the side facing the positioning slot 112 on the side wall of the separable block 12. The snap block 122 is matched with the positioning slot 112 and is detachably connected to the positioning slot 112, playing a role in positioning and fixing the separable block 12 and the recessed slot 11 in collaboration with the snap bulge 121 and the connection slot 111. In other embodiments of present disclosure, when there is no connection slot 111 and/or positioning slot 112 in the recessed slot 11, the separable block 12 is also not provided with a snap bulge 121 and/or a snap block 122.

It should be noted that the structural design of setting the recessed slot 11 and separable block 12 on the end wall 10*a* has the advantage of a more streamlined and compact connection structure between the separable block 12 and the end wall 10*a* compared to the structure of setting the separable puzzle unit blocks on the side wall in existing technology, which is beneficial for reducing production costs and improving assembly efficiency. Moreover, setting the recessed slot 11 and the separable block 12 on the end wall 10*a* not only facilitates the operation of flipping the separable block 12, but also enables the slider 20 to move on the side wall 10*b* without being limited by the pattern of the separable block 12.

The outer surface of the side wall 10*b* is provided with a plurality of the sliding grooves which are intersected with each other along the circumferential and longitudinal directions, and the sliding groove is movably connected with a part structure of slider 20. In the first embodiment, the sliding groove includes three circumferential sliding grooves 14 and twelve longitudinal sliding grooves 15, wherein one longitudinal sliding groove 15 passes through the connection between the recessed slot 11 and the side wall 10*b* and extends towards the bottom wall of the recessed slot 11 to enable the slider 20 to enter and exit the recessed slot 11 under the guidance of the longitudinal sliding groove 15. In other embodiments of present disclosure, the number of circumferential sliding grooves 14 and longitudinal sliding grooves 15 can be adaptively adjusted according to the number and arrangement of sliders 20.

Each slider 20 includes a plate 21 and a base pillar 22 arranged in a vertical direction, wherein the plate 21 is exposed on the side wall 10*b* and matched with the side wall 10*b*, that is, when the side wall 10*b* is a closed curved surface, the plate 21 is an arc-shaped plate; when the side wall 10*b* is connected by multiple closed planes, the plate 21 is a flat plate. A pattern can be set on the plate 21 through spraying, adhesive connection, snap-fit connection, buckle connection, threaded connection, bolt connection, or magnetic connection. The patterns of several plates 21 can be spliced to form a complete large pattern, and the game can be played by restoring the disrupted patterns of several plates 21.

The base pillar 22 passes through the sliding groove to movably connect the slider 20 within the sliding groove. In the first embodiment, a positioning piece 23 is slidably sleeved on the base pillar 22, and the positioning piece 23 is movably connected in the sliding groove along with the base pillar 22 and contacts with the inner wall of the sliding groove. There is an elastic member 24 (such as a spring, etc.) connected between the positioning piece 23 and the end of the base pillar 22, which is used for providing an extra space for slider 20 to move smoothly on the main body 10 when the slider 20 crosses the connection between the recessed slot 11 and the side wall 10*b* and when the slider 20 crosses any arc-shaped transition surface 102, ensuring that the sliding puzzle toy 1 has a good gaming feel. In the other embodiments, the slider 20 can also adopt other structures to achieve the purpose of being movable and connected within the sliding groove, for example, a magnet may be provided fixed at the end of the base pillar 22 in each slider 20, and the magnet is movably connected in the sliding groove along with the base pillar 22. At this time, a magnetic film is set on the outer side on the side wall 10*b* opposite to the magnet, and the magnetic film is magnetically connected to the magnet to slidably connect the slider 20 to the main body 10.

During the game, the separable block 12 is rotated to open the recessed slot 11. By manually pushing the plate 21, the base pillar 22 is driven to move between the circumferential sliding grooves 14 and the longitudinal sliding grooves 15 which are intersected with each other, in order to change the relative position of any slider 20 on the side wall 10*b*, until the disrupted large pattern is restored to end the game.

Please refer to FIG. 9 to FIG. 12, a sliding puzzle toy 1 of the third embodiment of the present disclosure is provided, which differs from the first embodiment in that the separable block 12 can be slidably connected within the recessed slot 11. In the third embodiment, the length of the separable block 12 is equal to the length of the recessed slot 11. At this time, the other side of the recessed slot 11 is connected to the outside, making the recessed slot 11 a straight structure with both ends intercommunicated. By pushing the separable block 12 forward or backward, the recessed slot 11 can be opened or closed. Moreover, the other side of the recessed slot 11 can also be intercommunicated to the side wall 10*b* at the same time. By pushing the separable block 12 forward or backward, the recessed slot 11 can be can opened to increase the utilization convenience of the sliding puzzle toy. In other embodiments of the present disclosure, the other side of the recessed slot 11 can also be set only to be connected to the outside.

In order to ensure that the separable block 12 is securely slidably connected within the recessed slot 11, a guide slot 113 is provided on the side wall of the recessed slot 11 along the movement direction of the separable block 12. The separable block 12 is provided with a first sliding plate 123 on the side wall opposite to the guide slot 113, and the first sliding plate 123 and the guide slot 113 are in a concave-convex sliding fit. In the third embodiment, in order to make it difficult for the separable block 12 to detach from the recessed slot 11, the bottom wall of the recessed slot 11 is further provided with a limit slot 114 along the movement direction of the separable block 12. The separable block 12 is provided with a second sliding plate 124 on the side wall opposite to the limit slot 114, and the second sliding plate 124 and the limit slot 114 are in a concave-convex sliding fit. Obviously, in other embodiments, the bottom wall of the recessed slot 11 may not be equipped with a limited slot 114, and at this time, the separable block 12 may not be correspondingly equipped with a second sliding plate 124.

Figure 13:
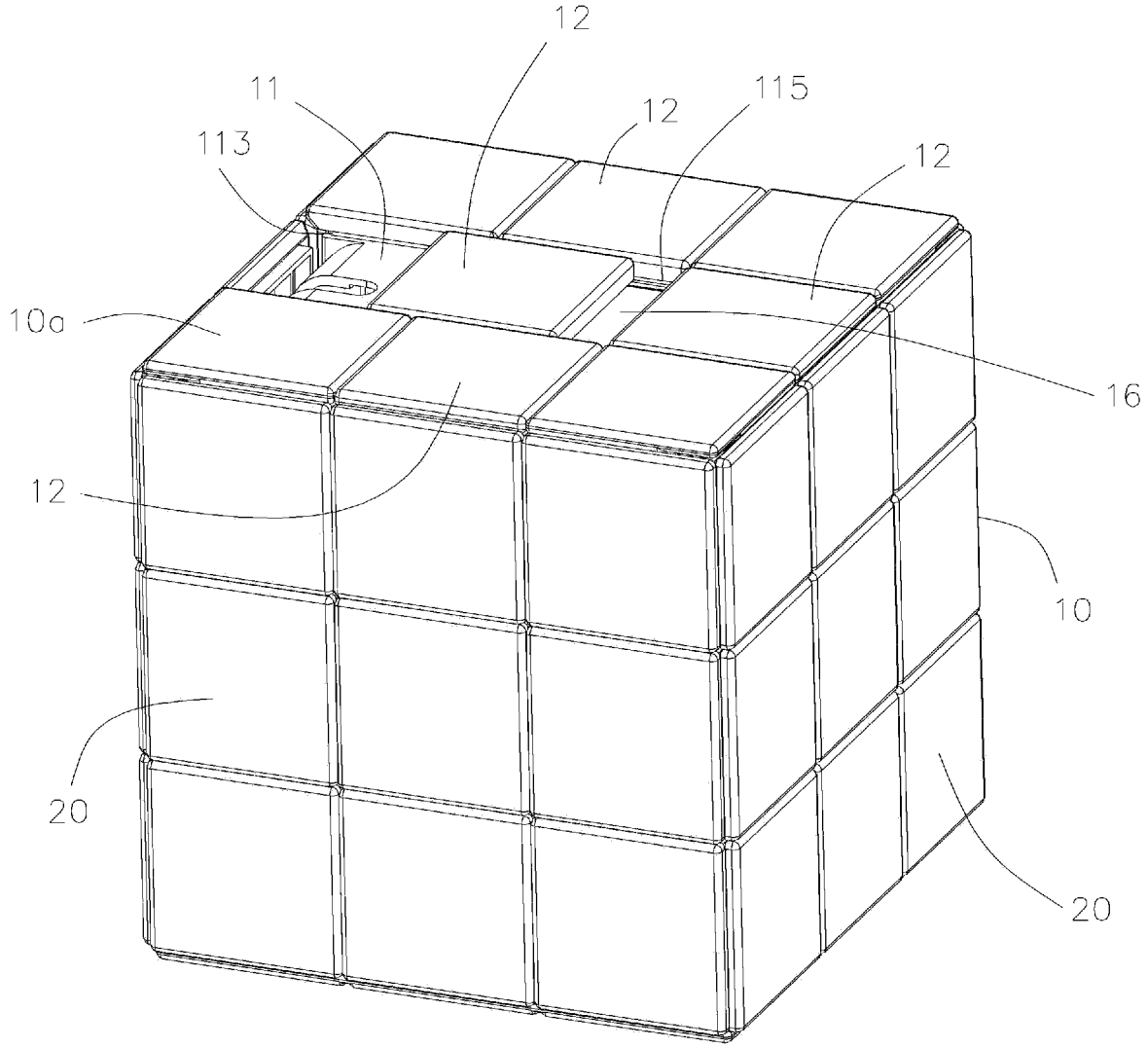
FIG. 13 is a schematic diagram of the separable block in opened state of the sliding puzzle toy in the fourth embodiment of the present disclosure.
Figure 14:
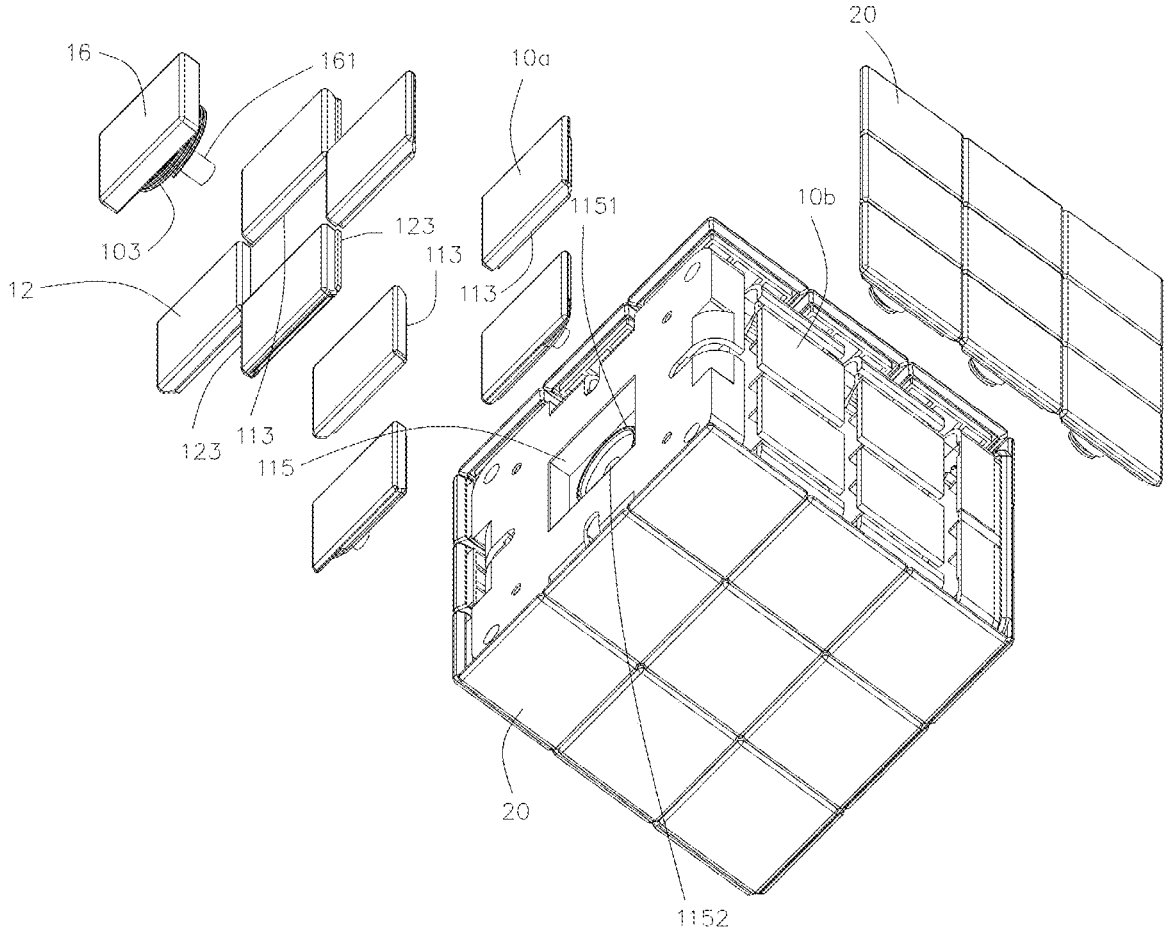
FIG. 14 is a partial exploded view of the sliding puzzle toy in FIG. 13.
Figure 15:
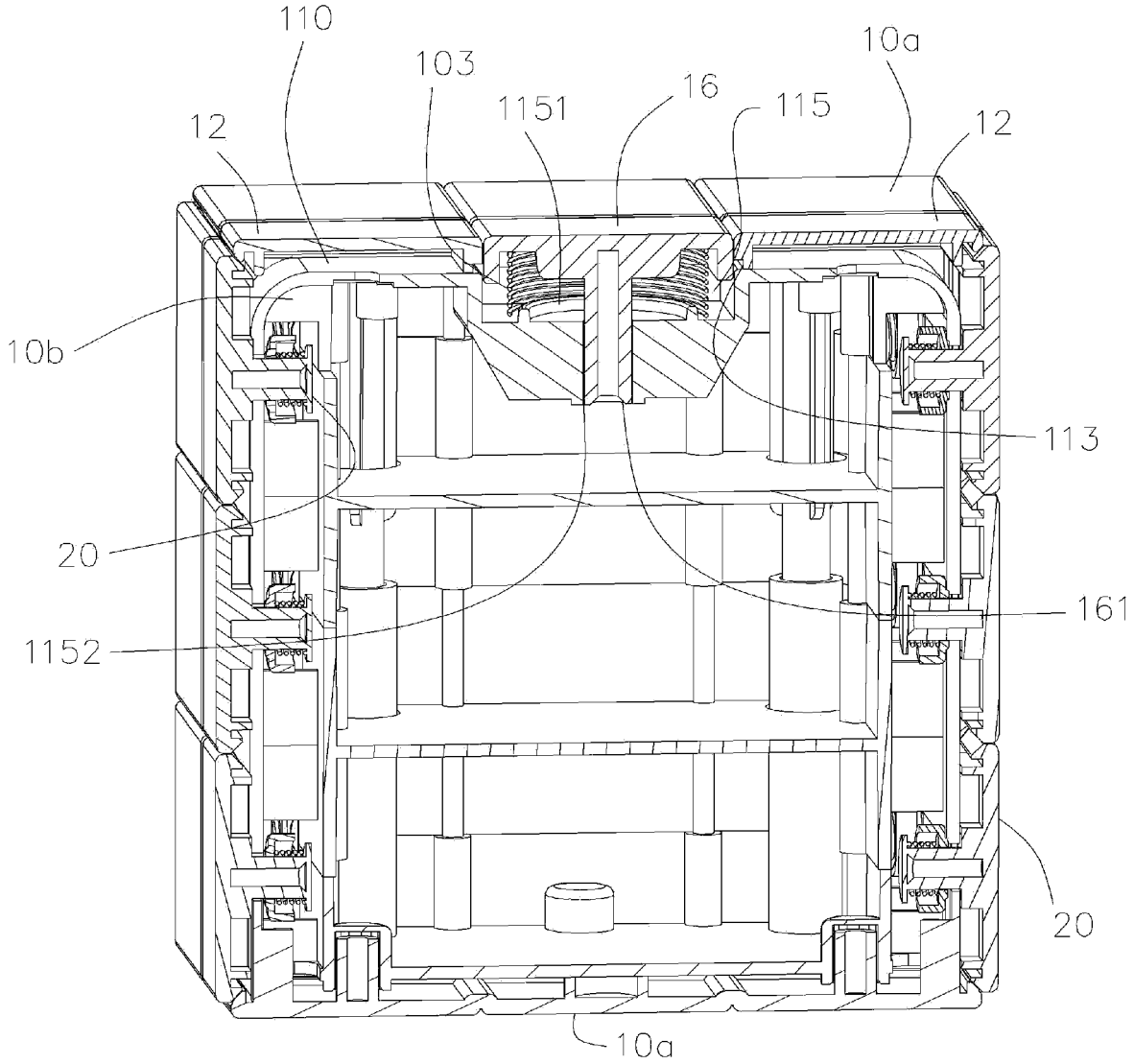
FIG. 15 is a cross-sectional schematic diagram of the sliding puzzle toy in FIG. 13.

Please refer to FIG. 13 to FIG. 15, a sliding puzzle toy 1 of the fourth embodiment of the present disclosure is provided, which differs from the third embodiment is that in the fourth embodiment, the length of the separable block 12 is smaller than the length of the recessed slot 11. At this time, the part of the recessed slot 11 far away from the side wall 10*b* is recessed to form a receiving cavity 115, and the receiving cavity 115 is connected to a moving block 16 through an elastic member (such as the first spring 103). As the moving block 16 moves within the receiving cavity 115, the moving block 16 has a first state adjacent to the separating block 12 and a second state overlapped with the separating block 12. Therefore, when the moving block 16 moves downwards towards the receiving cavity 115, it can still move the separating block 12 within the recessed slot 11 to the second state overlapped with the moving block 16, achieving the opening of the recessed slot 11.

In other embodiments of the present disclosure, the receiving cavity 115 in the recessed slot 11 can also be set adjacent to the side wall 10*b* according to different shapes and structures of the puzzle toy. The moving block 16 can also be movably connected to the receiving cavity 115 through other means, such as a structure with concave-convex moving fit, a structure with meshing moving fit, etc.

In the fourth embodiment, the recessed slot 11 includes two sub slots 110 that intersect with each other in a cross shape. The intersection position of the two sub slots 110 is recessed to form a receiving cavity 115, and each sub slot 110 is sliding with two separable blocks 12. By pushing any separable block 12 to move and overlap with the moving block 16, the recessed slot 11 can be opened, so as to increase the utilization convenience of the sliding puzzle toy. It can be understood that since recessed slot 11 is composed of two cross intersecting sub slots 110, four separable blocks 12 are respectively moved and set at the midpoint positions of the four sides of the end wall 10*a* on one end wall 10*a* of the main body 10. At this time, guide slots 113 are set on either of the two vertical edges of the recessed slot 11 in end wall 10*a*, and first sliding plates 123 are set on both sides opposite to the guide slots 113 in any separable block 12. Meanwhile, any separable block 12 is further provided with guide slots 113 on the side wall adjacent to the moving block 16, allowing any separable block 12 to move onto the moving block 16. In other embodiments of the present disclosure, according to the shape and setting requirements of the main body 10, the recessed slot 11 may also include three or more intersecting sub slots 110. At this time, the intersection position of any two sub slots 110 is recessed to form a receiving cavity 115, and at least one separable block 12 is sliding inside each sub slot 110.

In the fourth embodiment, the bottom wall of the receiving cavity 115 is provided with a retaining ring 1151. The end of the first spring 103 is detachably clamped and fixed on the retaining ring 1151, the other end of the first spring 103 is in contact with the moving block 16, allowing the moving block 16 to move towards the receiving cavity 115 under external force. At the same time, when the external force on the moving block 16 is withdrawn, the moving block 16 can be pushed to reset through the first spring 103, so that the moving block 16 can transform between the first state and the second state. It can be understood that in order to guide the moving block 16 to move in the correct direction within the receiving cavity 115, the bottom wall of the receiving cavity 3313 is also provided with a moving cavity 1152. At this time, the moving block 16 is provided with a connection post 161 on the side wall corresponding to the moving cavity 1152, and the connection post 161 can be movably connected within the moving cavity 1152. In other embodiments of the present disclosure, the receiving cavity 115 may not be provided with a moving cavity 1152, accordingly, the moving block 16 is not provided with a connection post 161. The bottom wall of the moving cavity 1152 and the connection post 161 can also be connected through an elastic member (such as a spring) to enhance the ability of the moving block 16 to reset automatically.

Figure 16:
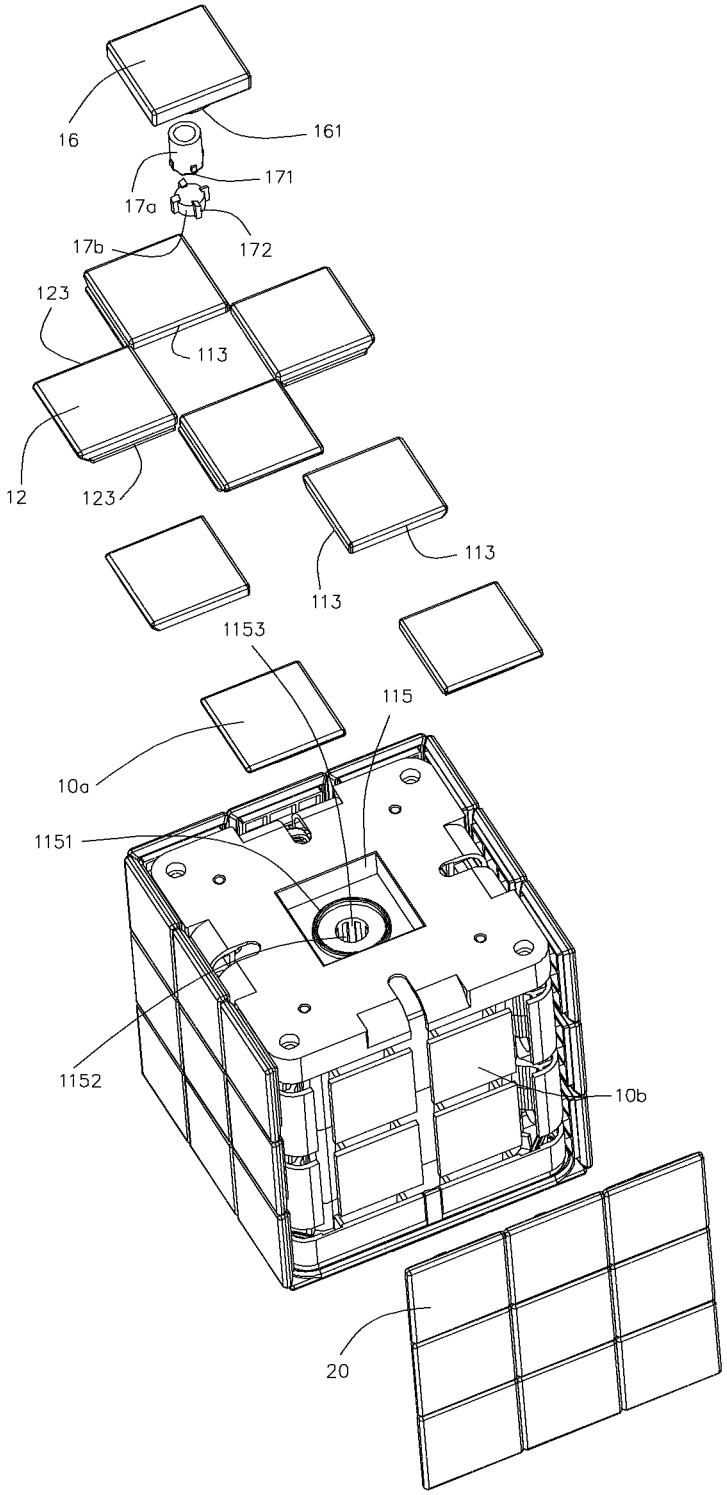
FIG. 16 is a partial exploded view of a sliding puzzle toy in the fifth embodiment of the present disclosure.
Figure 17:
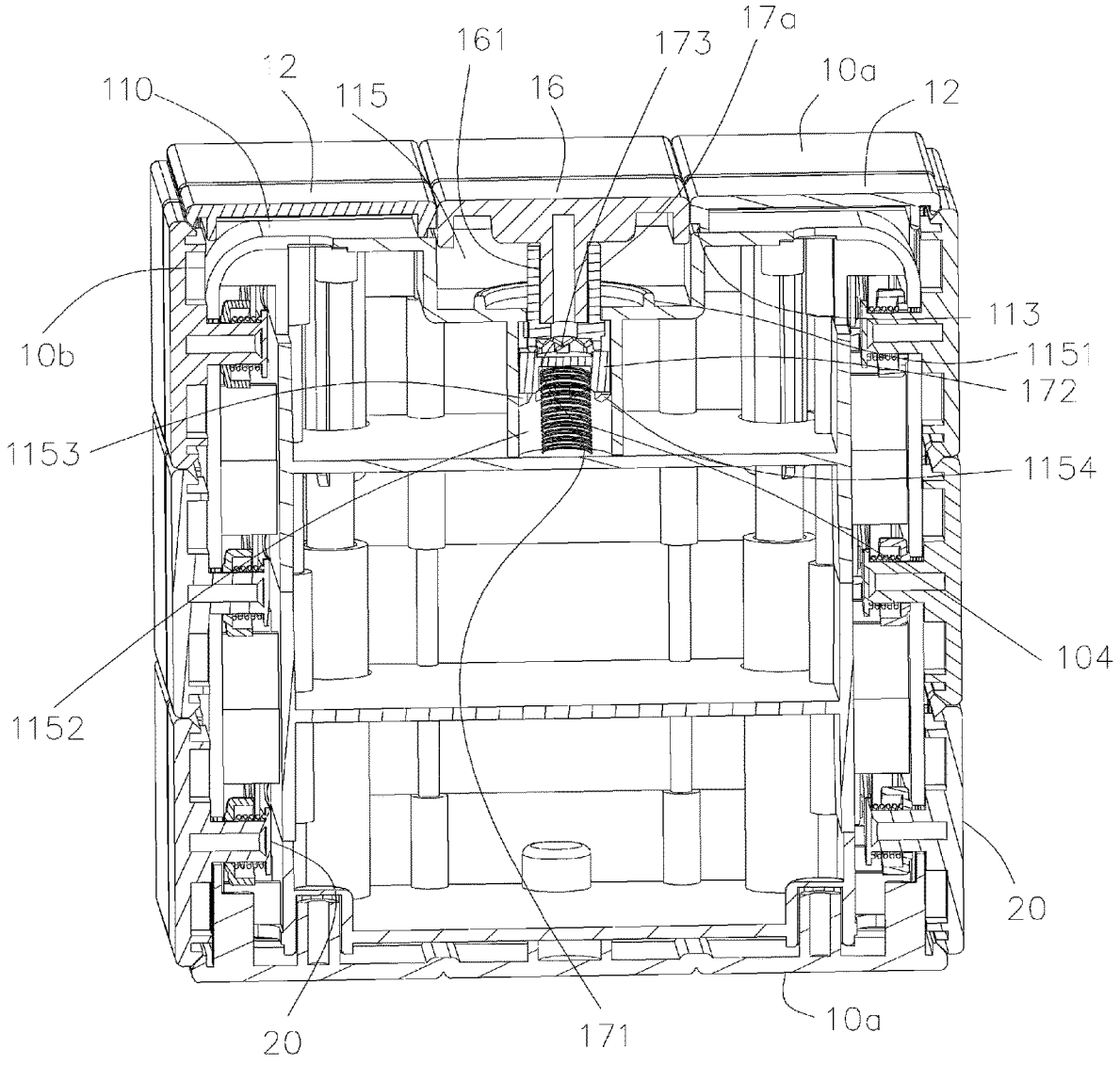
FIG. 17 is a cross-sectional schematic diagram of the sliding puzzle toy in FIG. 16.
Figure 18:
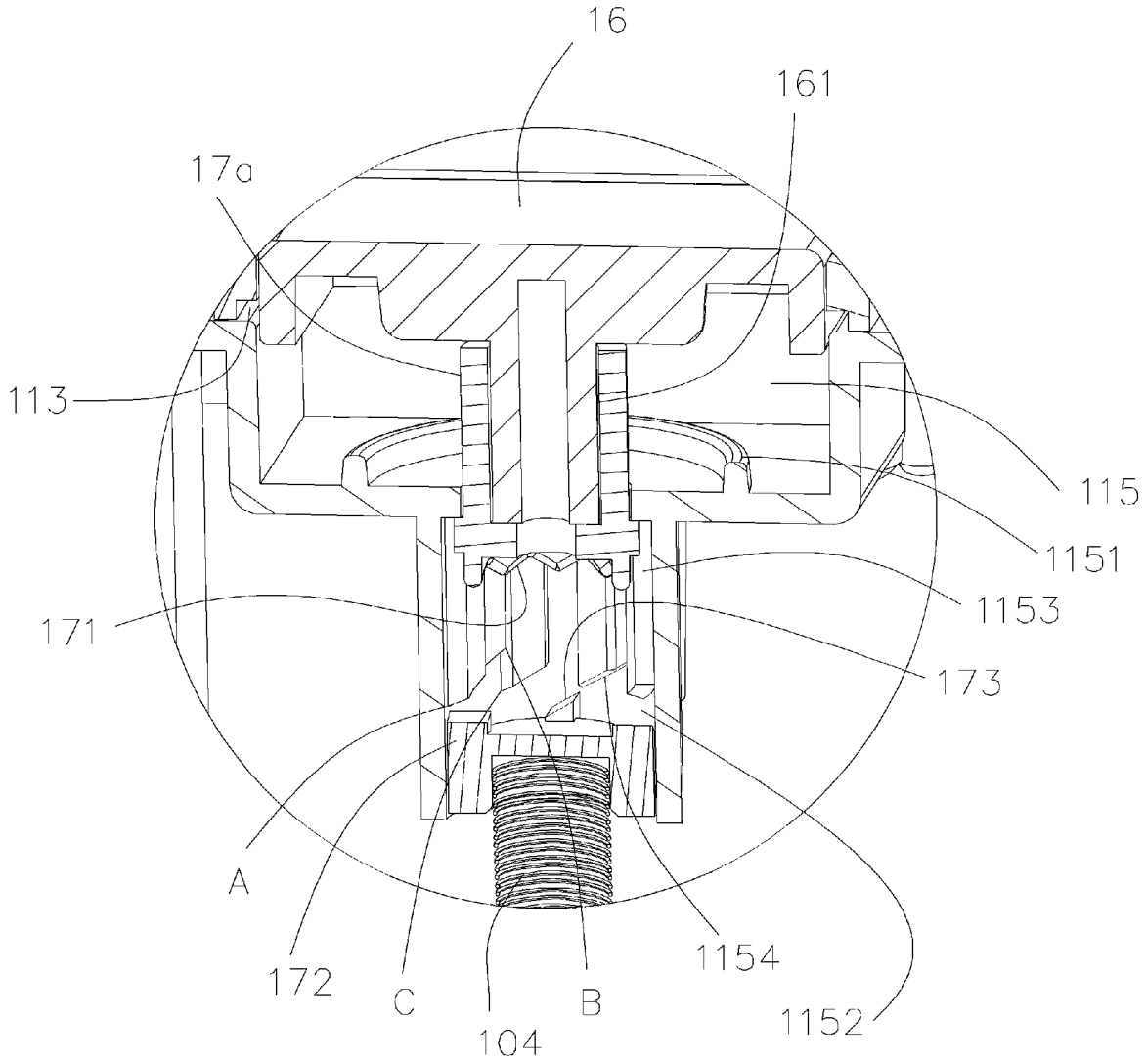
FIG. 18 is a partially cross-sectional schematic diagram of the moving block in FIG. 16, which is movably connected in the receiving cavity by a pushing block and a limit block.

Please refer to FIG. 16 to FIG. 18, a sliding puzzle toy 1 of the fifth embodiment of the present disclosure is provided, which differs from the fourth embodiment is that there are a plurality of guiding ribs 1153 arranged at circumferential intervals on the side walls of the moving cavity 1152, and the end of each guiding rib 1153 is provided with a first inclined surface 1154. The first inclined surface 1154 is arranged in an inclined Z-shaped shape. At this time, there is no first spring 103 set on the retaining ring 1151, the connection post 161 can be movably connected in the moving cavity 1152 through the pushing block 17*a* and the limit block 17*b*, so that when the external force on the moving block 16 is withdrawn, it is still possible to fix the moving block 16 in the receiving cavity 115 through the connection between the guiding ribs 1153, the pushing block 17*a* and the limit block 17*b*.

The pushing block 17*a* is fixedly and slidably connected with the connection post 161 between the plurality of guiding ribs 1153, so that the pushing block 17*a* needs to move back and forth in the direction limited by the guiding ribs 1153. The pushing block 17*a* is provided with serrated claws 171 in the circumferential direction at the end of the moving cavity 1152, which are used to contact with the limit block 17*b* to push the limit block 17*b* to move within the moving cavity 1152.

The limit block 17*b* is connected to the bottom wall of the moving cavity 1152 through an elastic member (such as the second spring 104), and the outer wall of the limit block 17*b* is provided with a plurality of positioning ribs 172. Each positioning rib 172 is slidably connected between any two guiding ribs 1153, so that the limit block 17*b* needs to move back and forth in the direction restricted by the guiding ribs 1153. Each positioning rib 172 is provided with a second inclined surface 173 at the end opposite to the serrated claws 171. The second inclined surface 173 contacts to the serrated claws 171, so that the limit block 17*b* can slide on the guiding ribs 1153 under the driving force of the pushing block 17*a*. The inclination direction and the inclination angle of each second inclined surface 173 are the same as those of the first inclined surface 1154, so that the second inclined surface 173 can move along the first inclined surface 1154 when moving to the endpoint position of the first inclined surface 1154, therefore, each positioning rib 172 can rotate and move between adjacent guiding ribs 1153 to achieve the positioning and resetting of the moving block 16.

It should be noted that the process of moving block 16 moving within the moving cavity 1152 by the pushing block 17*a* and the limit block 17*b* is roughly as shown in FIG. 17 and FIG. 18. If the moving block 16 is pressed, the pushing block 17*a* will push the limit block 17*b* to slide within the guiding ribs 1153 through the serrated claws 171. At this time, the second spring 104 is in a compressed state. When the limit block 17*b* moves to the intersection of point A of the second inclined surface 173 and the first inclined surface 1154, the limit block 17*b* will be pushed by the elastic force of the second spring 104, causing the second inclined surface 173 to cross point A and move along the first inclined surface 1154 to point B of the first inclined surface 1154. At this time, the positioning rib 172 will be clamped on the first inclined surface 1154, enabling the moving block 16 to be positioned and fixed in the receiving cavity 115, further increasing the utilization convenience of the sliding puzzle toy. If the moving block 16 is pressed again, the pushing block 17*a* will push the limit block 17*b* again to slide within the first inclined surface 1154. At this time, the second spring 104 is in a compressed state. When the limit block 17*b* moves to the intersection of point C on the second inclined surface 173 and the first inclined surface 1154, when the external force on the moving block 16 is withdrawn, the limit block 17*b* will be pushed by the elastic force of the second spring 104, enabling the second inclined surface 173 cross point C and move along the first inclined surface 1154 between any two guiding ribs 1153. Finally, under the force of the second spring 104, the pushing block 17*a* is pushed to drive the moving block 16 to move and reset (as shown in FIG. 17).

Figure 19:
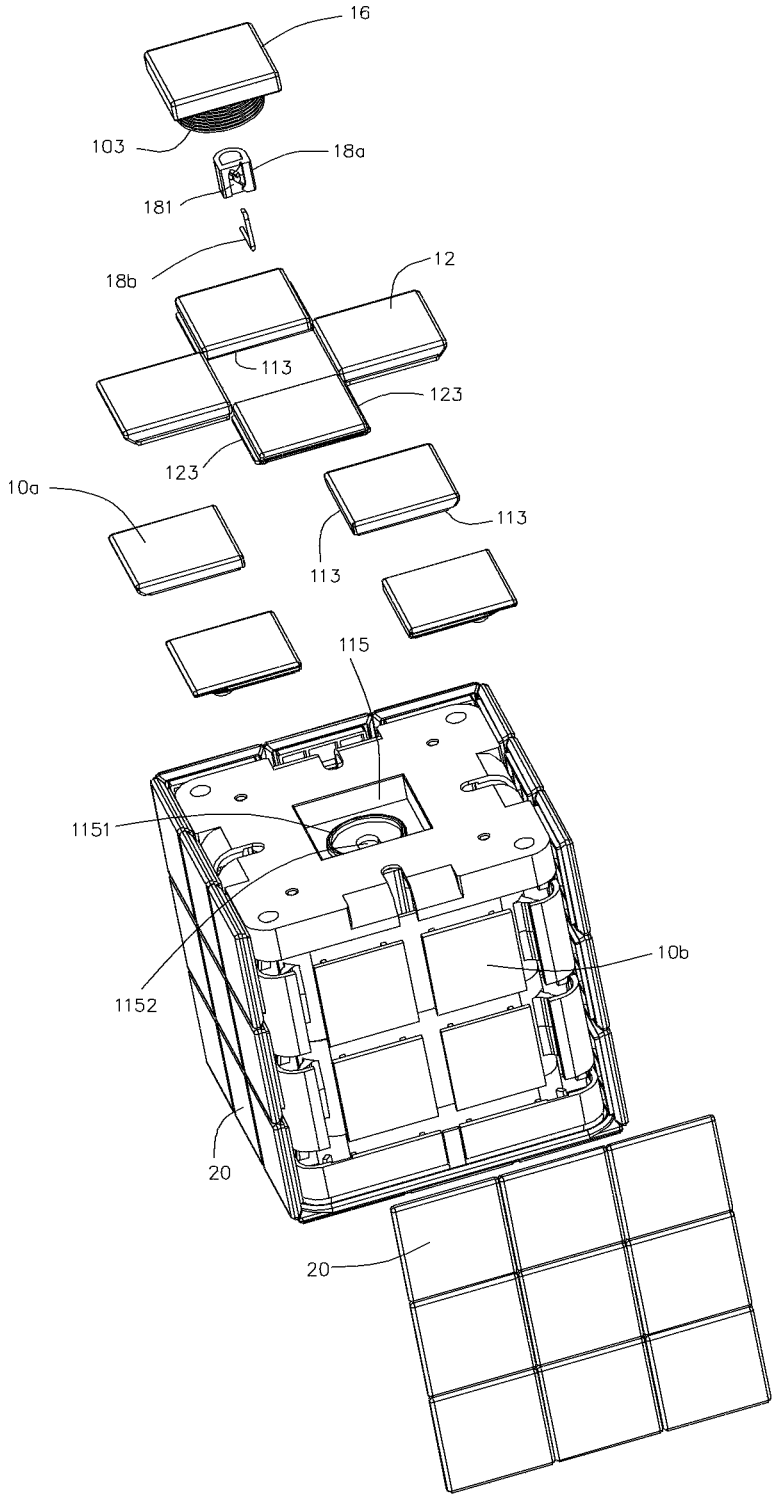
FIG. 19 is a partial exploded view of a sliding puzzle toy according to the sixth embodiment of the present disclosure.
Figure 20:
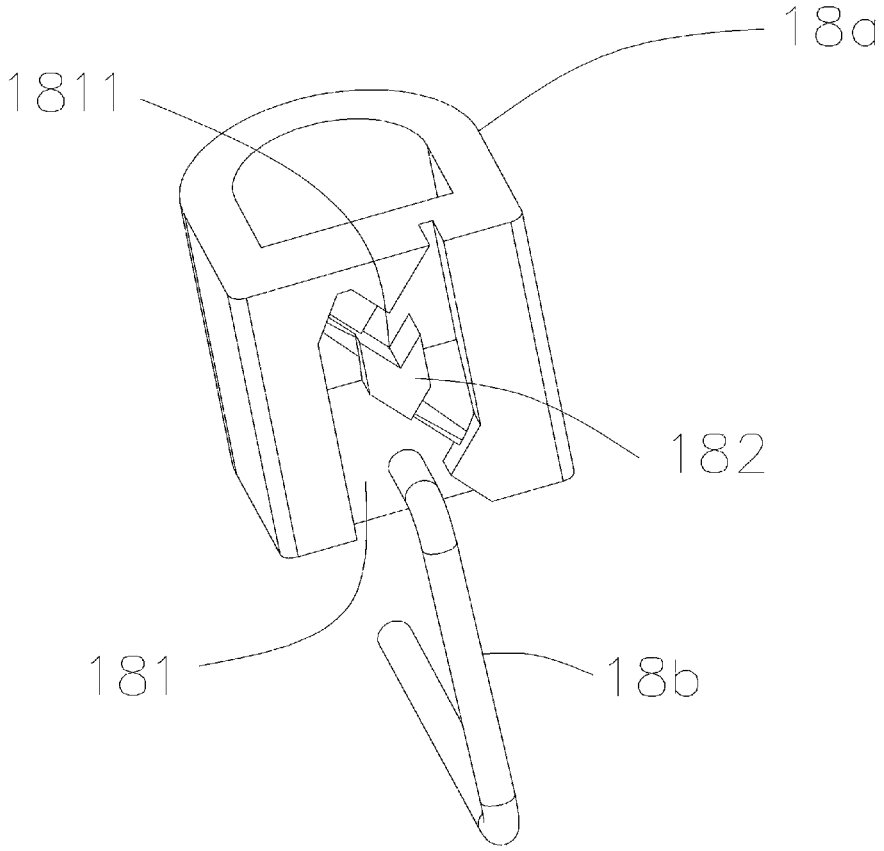
FIG. 20 is a schematic diagram of the connection between the restriction block and the restriction rod in FIG. 19.
Figure 21:
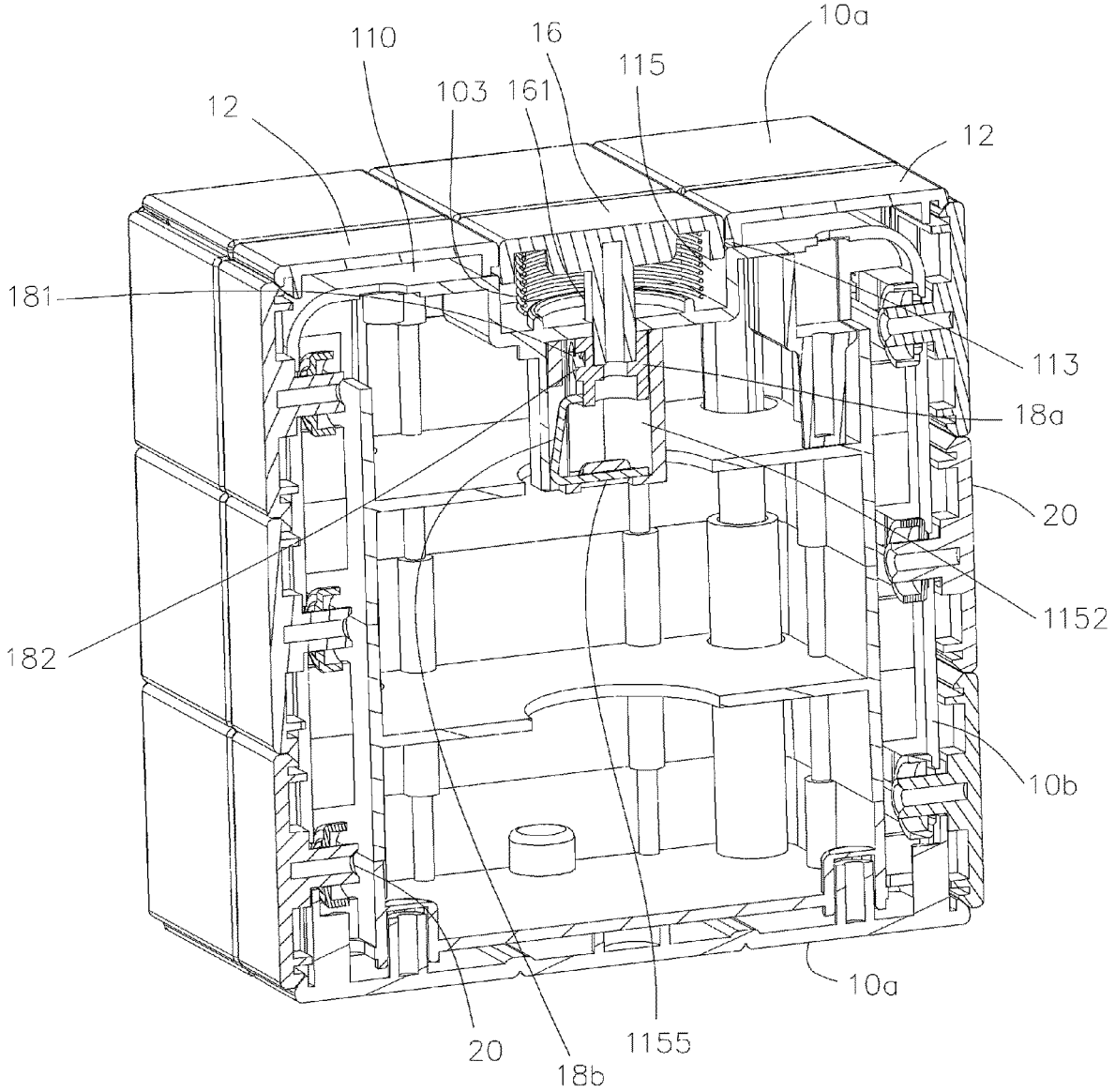
FIG. 21 is a cross-sectional schematic diagram of the sliding puzzle toy in FIG. 19.

Please refer to FIG. 19 to FIG. 21, a sliding puzzle toy 1 of the sixth embodiment of the present disclosure is provided, which differs from the fourth embodiment is that the bottom wall of the moving cavity 1152 is provided with a mounting hole 1155. At this time, the receiving cavity 115 and the moving block 16 are still connected by the first spring 103. The connection post 161 can be movably connected in the moving cavity 1152 through the restriction block 18*a* and the restriction rod 18*b* to achieve that when external force on the moving block 16 is withdrawn, it is still possible to fix the moving block 16 in the receiving cavity 115 through the connection between the restriction block 18*a* and the restriction rod 18*b*.

The restriction block 18*a* is fixed and slidably connected to the connection post 161 in the mobile cavity 1152. One side of the wall of the restriction block 18*a* is provided with a channel 181. In the sixth embodiment, an arrow-shaped raised rib 182 is arranged in the middle of the channel 181, to make a M-shaped passage form inside the channel 181. At this time, the channel 181 is provided with a recessed point 1811 which is recessed downwards. It should be noted that in order to limit the movement path of the restriction rod 18*b* within the channel 181, the side walls of the channel 181 are equipped with inclined planes that are guided in conjunction with the raised ribs 182. In other embodiments of the present disclosure, channel 181 may not be limited to the M-shaped passage configuration in this embodiment, and the channel 181 may also be configured in other shapes with a recessed point 1811.

One end of the restriction rod 18*b* is fixed in the mounting hole 1155, and the other end of the restriction rod 18*b* corresponds to a raised rib 182 and can be movably connected in the channel 181, so that the end of the restriction rod 18*b* can move with the movement of the restriction block 18*a*, and move to the recessed point 1811 of the channel 181 to engage or separate, thereby achieving the positioning and resetting of the moving block 16.

It should be noted that the process of the moving block 16 moving within the moving cavity 1152 through the restriction block 18*a* and the restriction rod 18*b* is roughly as follows: as shown in FIG. 20 and FIG. 21, if the moving block 16 is pressed, the connection post 161 will drive the restriction block 18*a* to move within the moving cavity 1152. At this time, the end of the restriction rod 18*b* moves to clamp with the recessed point 1811 of the channel 181 under the guidance of the raised rib 182 and the side wall of the channel 181, so that the moving block 16 can be positioned and fixed in the receiving cavity 115, at this point, the first spring 103 is in a compressed state. If the moving block 16 is pressed again, the restriction block 18*a* moves with the connection post 161 in the moving cavity 1152, so that the end of the restriction rod 18*b* can move to separate from the recessed point 1811 of the channel 181 under the guidance of the raised rib 182 and the side wall of the channel 181. Therefore, when the external force on the moving block 16 is withdrawn, the end of the restriction rod 18*b* can move again in the channel 181, finally, under the force of the first spring 103, the moving block 16 is driven to move and reset (as shown in FIG. 21).

For clarity, certain features described in the embodiments of this present disclosure can be combined for use in one embodiment. Moreover, the various features of the present disclosure described in a single embodiment can also be used individually or in any suitable form in sub combinations.

What is claimed is:

1. A sliding puzzle toy, comprising a main body and a plurality of sliders slidably connected to the main body, wherein the main body comprises two end walls, and a side wall connected between the two end walls, at least one of the two end walls is provided with a recessed slot and a separable block, one side of the recessed slot is connected to the side wall, an arc transition is provided at a connection between the recessed slot and the side wall, and the separable block is movably or detachably connected to the recessed slot; an outer surface of the side wall is provided with a plurality of sliding grooves that intersects with each other along circumferential and longitudinal directions, the sliding grooves are movably connected to the sliders, and one of the longitudinal sliding grooves passes through a connection between the recessed slot and the side wall and extends towards a bottom wall of the recessed slot;

the separable block matches with the recessed slot, one side of the separable block is detachably connected to an open side of the recessed slot, and an other side of the separable block is pivoted to a side wall of the recessed slot.

2. The sliding puzzle toy according to claim 1, wherein the separable block is connected to the end wall through a connection strip, the connection strip is accommodated and connected between the separable block and end wall, and the two ends of the connection strip are respectively pivoted to the separable block and the end wall.

3. The sliding puzzle toy according to claim 1, wherein each slider comprises a plate and a base pillar arranged along a vertical direction, the plate is exposed to the side wall, the base pillar is movably connected in the sliding groove, a positioning piece is slidably sleeved on the base pillar, the positioning piece is movably connected to the sliding groove and contacts with an inner wall of the sliding groove, and an elastic member is connected between the positioning piece and an end of the base pillar.

* * * * *